US007674196B2

(12) United States Patent
Tsai

(10) Patent No.: US 7,674,196 B2
(45) Date of Patent: Mar. 9, 2010

(54) ROBOT FOR COLLECTING TABLE TENNIS BALLS

(75) Inventor: Kuan-Teng Tsai, Taipei Hsien (TW)

(73) Assignee: Foxconn Technology Co., Ltd., Tu-Cheng, Taipei Hsien (TW)

( * ) Notice: Subject to any disclaimer, the term of this patent is extended or adjusted under 35 U.S.C. 154(b) by 141 days.

(21) Appl. No.: 12/061,614

(22) Filed: Apr. 2, 2008

(65) Prior Publication Data

US 2009/0137348 A1 May 28, 2009

(30) Foreign Application Priority Data

Nov. 23, 2007 (CN) ..... 2007 1 0124772

(51) Int. Cl.
*A63B 47/00* (2006.01)

(52) U.S. Cl. ..... 473/460; 414/440

(58) Field of Classification Search ..... 473/436, 473/460; 414/440; 294/19.2
See application file for complete search history.

(56) References Cited

U.S. PATENT DOCUMENTS 3,744,225 A * 7/1973 Reeves ..... 56/328.1
3,746,099 A * 7/1973 Black ..... 414/440
3,888,370 A * 6/1975 Gamblin ..... 414/440
4,318,654 A * 3/1982 Lee ..... 414/440
4,735,544 A * 4/1988 Stotts ..... 414/440
4,844,527 A * 7/1989 Ray ..... 294/19.2
4,966,400 A * 10/1990 Hull et al. ..... 294/1.4
5,152,565 A * 10/1992 Dodd ..... 294/19.2
2006/0068948 A1 * 3/2006 Mendoza ..... 473/460
2009/0137348 A1 * 5/2009 Tsai ..... 473/436

FOREIGN PATENT DOCUMENTS

FR 2700701 A1 * 7/1994

* cited by examiner

*Primary Examiner*—Raleigh W. Chiu
(74) *Attorney, Agent, or Firm*—Frank R. Niranjan

(57) ABSTRACT

A robot for collecting table tennis balls on the ground includes a body, a rotor mounted at a front of the body, a driving module mounted on the body, and a control device. The body is configured for receiving the picked table tennis balls therein. The driving module drives the body to travel and drives the rotor to rotate for picking up the table tennis balls. The control device is configured for controlling the driving module to drive the robot to travel on the ground along a predetermined route.

14 Claims, 6 Drawing Sheets

ROBOT FOR COLLECTING TABLE TENNIS BALLS

BACKGROUND OF THE INVENTION

1. Field of the Invention

The present invention relates to a robot, and more particularly to a robot for automatically collecting table tennis balls on the ground.

2. Description of Related Art

Table tennis is a popular competitive and recreational sport. The object of the game is to have a player on each side of the table so that each player can serve, return and rally a table tennis ball. During the playing of the table tennis, it is unavoidable that the table tennis balls will fall on the ground. All of the table tennis balls are manually picked up and collected by the players or assistants for re-use. The operation of the collection of the table tennis balls has a relatively low efficiency since it is generally done by manual labor.

What is needed, therefore, is a robot, to automatically collect the table tennis balls to replace the annoying manual operations.

SUMMARY OF THE INVENTION

A robot for collecting table tennis balls on the ground includes a body, a rotor mounted at a front of the body, a driving module mounted on the body, and a control device. The body is configured for receiving the picked table tennis balls therein. The driving module drives the body to travel and driving the rotor to rotate for picking up the table tennis balls. The control device is configured for controlling the driving module to drive the robot to travel on the ground along a predetermined route.

BRIEF DESCRIPTION OF THE DRAWINGS

Many aspects of the present robot can be better understood with reference to the following drawings. The components in the drawings are not necessarily drawn to scale, the emphasis instead being placed upon clearly illustrating the principles of the present robot. Moreover, in the drawings, like reference numerals designate corresponding parts throughout the several views.

DETAILED DESCRIPTION OF THE INVENTION

Figure 1:
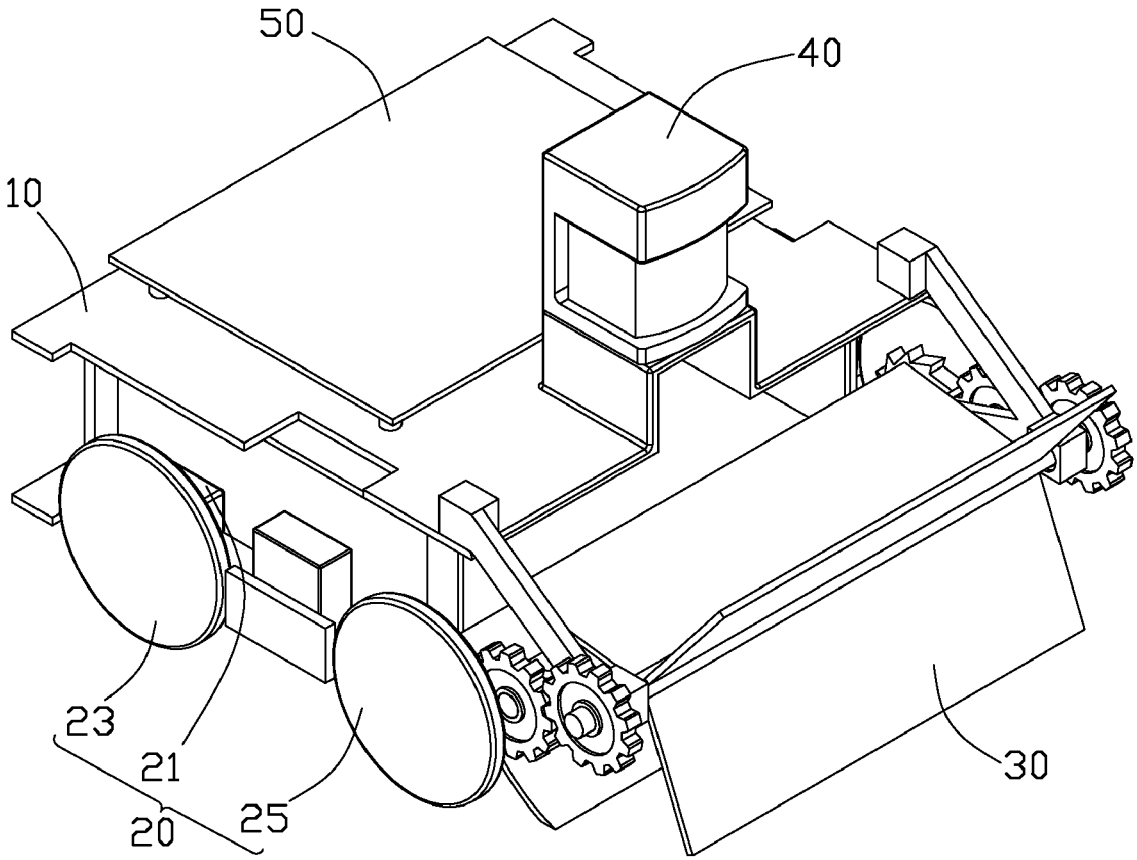
FIG. 1 is an assembled, isometric view of a robot for automatically collecting table tennis balls in accordance with a preferred embodiment of the present invention.
Figure 2:
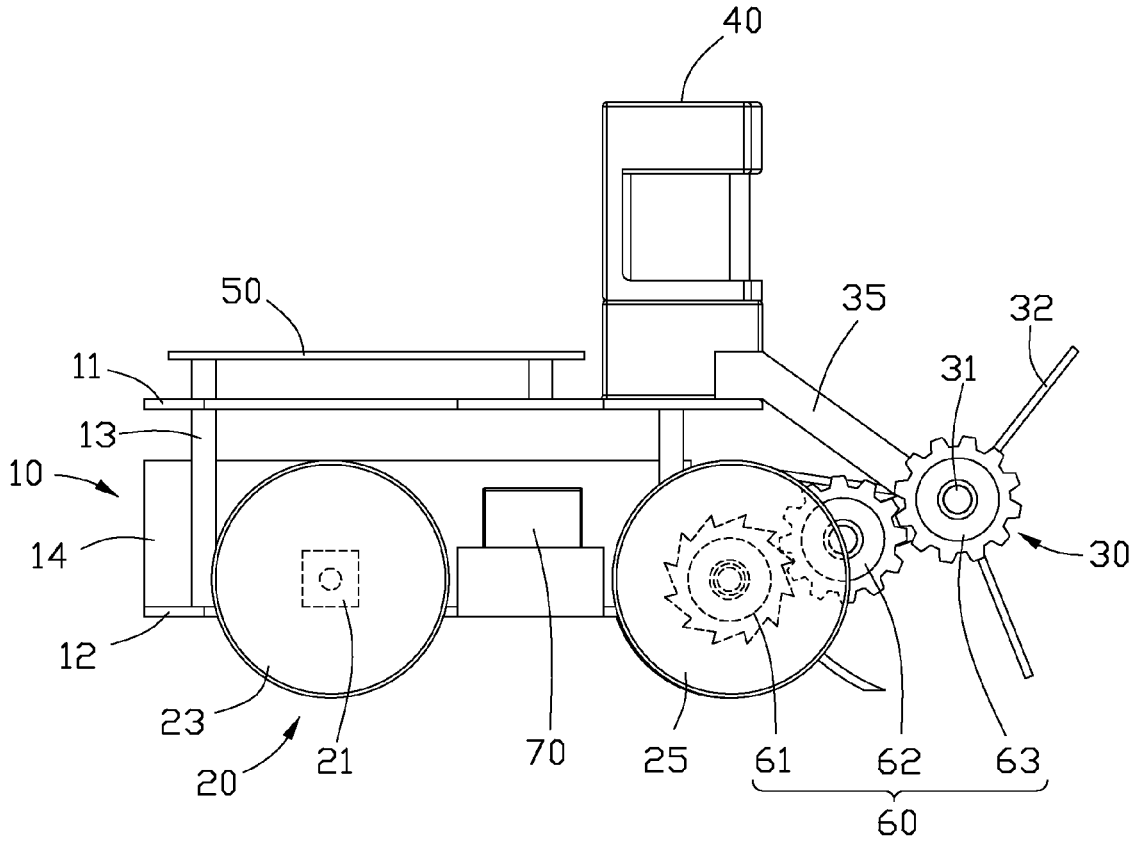
FIG. 2 is a left-side view of the robot of FIG. 1.
Figure 3:
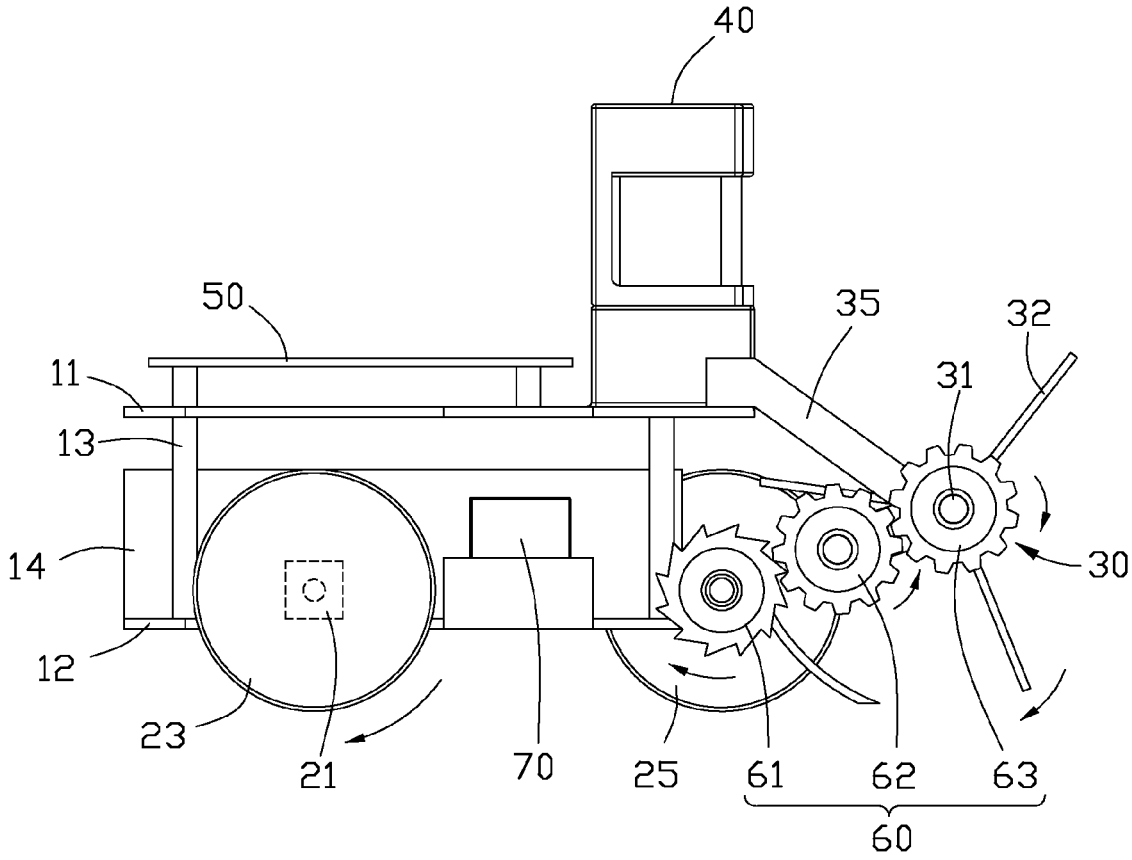
FIG. 3 is a view similar to FIG. 2, with a driven wheel being taken away for clarity.

FIGS. 1 and 2 show a robot (not labeled) for collecting table tennis balls of a preferred embodiment of the invention. The robot comprises a body 10, a driving module 20, a rotor means 30 for picking up the table tennis balls, a detection apparatus 40 and a control device 50. The driving module 20 comprises two motors 21 mounted on two lateral and rear portions of the body 10, two driving wheels 23 mounted on sides of the motors 21 respectively, and two driven wheels 25 mounted on the two lateral and front portions of the body 10. The driven wheels 25 drive the rotor means 30 to rotate via two gear sets 60 connecting with the driven wheels 25 and the rotor means 30. A power supply 70 is mounted on the body 10 for supplying electrical current to the motors 21, the detection apparatus 40 and the control device 50. In this embodiment, the power supply is a rechargeable battery.

Figure 4:
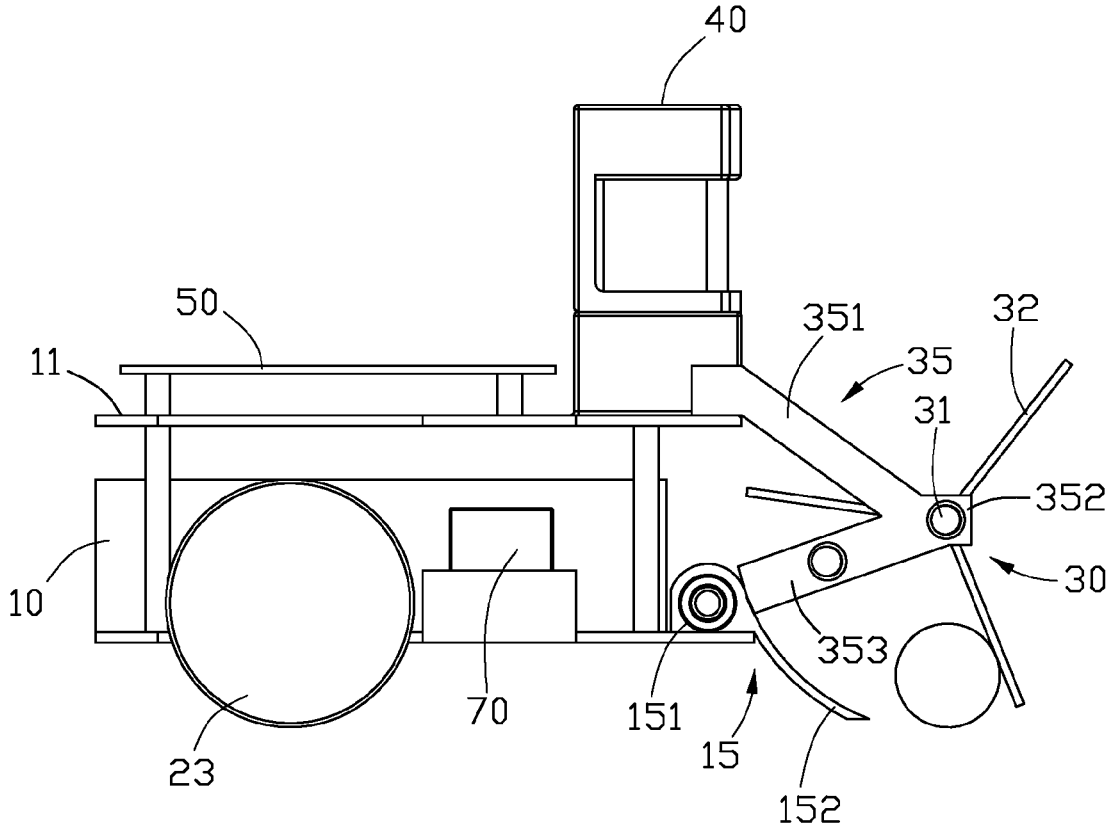
FIG. 4 is a view similar to FIG. 2, with two driven wheels and two gear sets of the robot being taken away for clarity, a table tennis ball being located at front of the robot to be collected by the robot.
Figure 5:
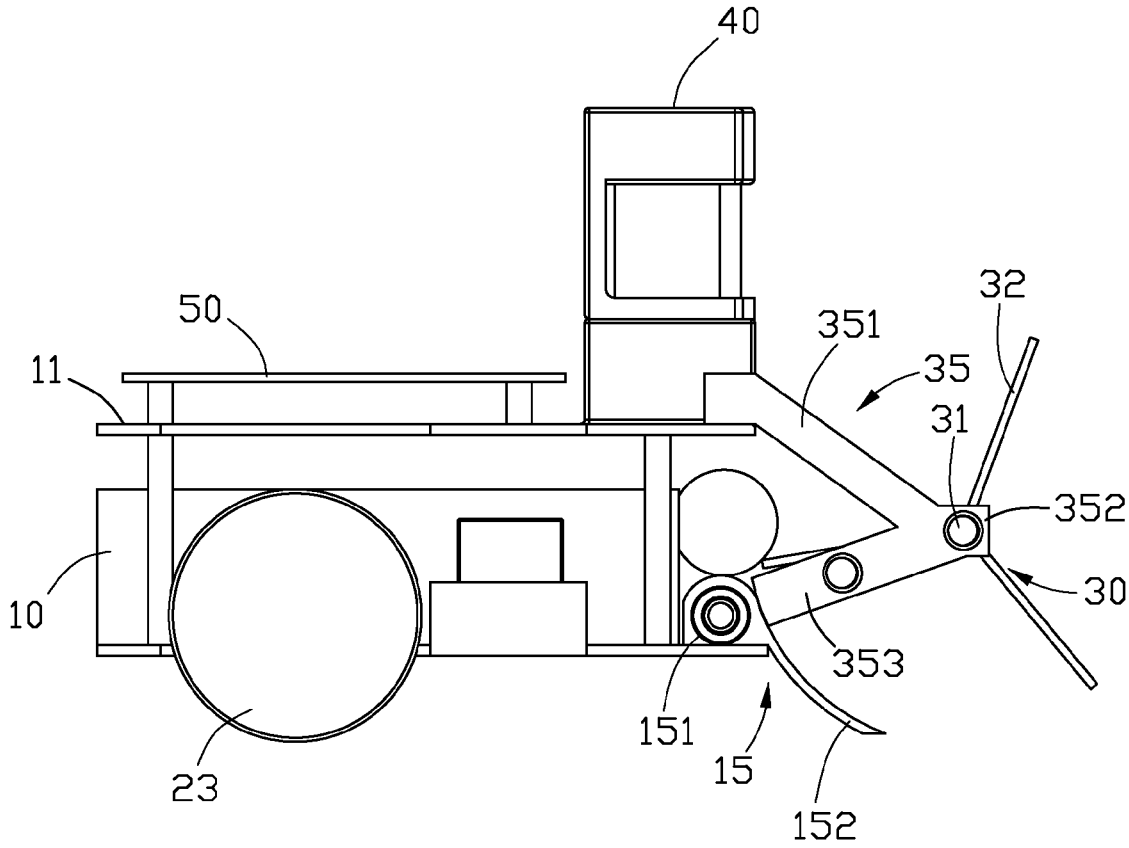
FIG. 5 is a view similar to FIG. 4, with the table tennis ball being picked up by the robot.
Figure 6:
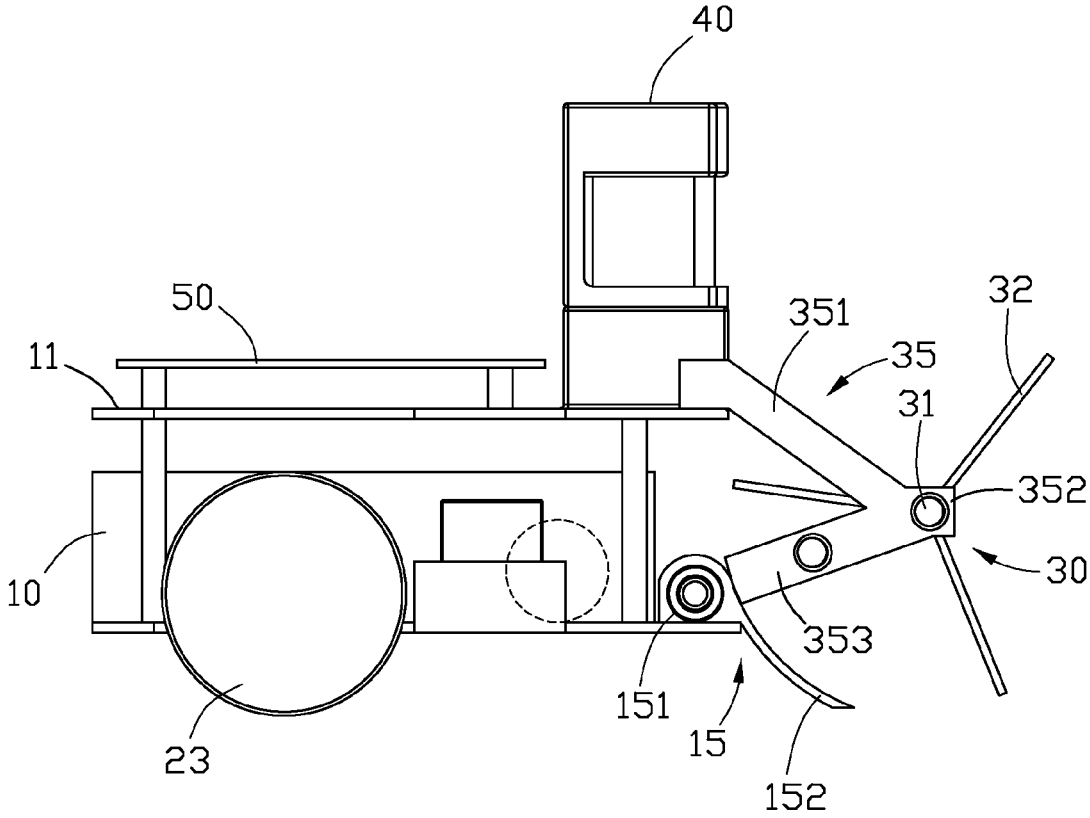
FIG. 6 is a view similar to FIG. 4, with the table tennis ball completely received in the robot.

The body 10 comprises a top plate 11, a bottom plate 12 parallel to top plate 11, and four poles 13 connecting the top plate 11 and the bottom plate 12. The bottom plate 12 forms three baffle walls 14 extending upwardly from a rear edge and two lateral edges thereof. The bottom plate 12 and the baffle walls 14 form a box (not labeled) for storing therein the table tennis balls picked up by the rotor means 30. The box has a front opening (not labeled) facing to the rotor means 30 located at the front of the body 10. Referring to FIG. 4, a guiding member 15 is mounted on the bottom plate 12 and located at the front opening of the box. The guiding member 15 comprises a mounting portion 151 mounted on the front edge of the bottom plate 12 and an arc-shaped lip 152 extending frontward and downwardly from the mounting portion 151. A lower end of the lip 152 is located close to the ground. The driven wheels 25 are pivotally engaged with the mounting portion 151. The lip 152 cooperates with the rotor means 30 to pick up the table tennis balls on the ground.

The motors 21 of the driving module 20 are mounted on the bottom plate 12 and located outside of two opposite baffle walls 14. The motors 21 can be stepper motors, or servo motors. In this embodiment, the motors 21 are DC servo motors. The driving wheels 23 are respectively mounted on the corresponding motors 21, for driving the robot to move. The driving wheels 23 each have a disc-shaped configuration. The driven wheels 25 each have a configuration similar to the driving wheel 23. When the driving wheels 23 and the driven wheels 25 are controlled to rotate, the body 10 can move in a predetermined travelling route.

Referring to FIG. 4, the rotor means 30 comprises two brackets 35 mounted on two sides of the front of the body 10, a shaft 31 having two ends engaged in the brackets 35 and three blades 32 extending radially from an outside surface of the shaft 31. Each bracket 35 has a V-shaped configuration, and comprises an upper arm 351, a lower arm 353 and a connecting portion 352 connecting with the upper arm 351 and the lower arm 353. The upper arms 351 are mounted on two lateral portions of the top plate 11. The lower arm 353 rests on the mounting portion 151 of the guiding member 15. The connecting portions 352 each define a pivotal hole (not labeled) for pivotally receiving the two ends of the shaft 31. The blades 32 are driven to revolve by the shaft 31 to cooperate with the lip 152 of the guiding member 15 to pick up the table tennis balls.

Each of the gear sets 60 comprises a ratchet 61 mounted on an inner side of the driven wheel 25, a driven gear 63 mounted on the end of the shaft 31, and an intermediate gear 62 pivotally mounted on the lower arm 353 of the bracket 35. The intermediate gear 62 intermeshes with the ratchet 61 and the driven gear 63. Thus the ratchet 61 can drive the driven gear 63 to rotate via the intermediate gear 62.

The detection apparatus 40 is an infrared sensor in this embodiment of the invention. The detection apparatus 40 is mounted on the top plate 11 of the body 10. The detection apparatus 40 sends up infrared light frontward, and then receives the infrared light reflected by an object located in front of the robot. The detection apparatus sends signals, in response to the received infrared light, to the control device 50 to control the driving module 20 and adjust the travelling route of the robot. Thus the robot can automatically move without the fear of colliding with the object.

The control device 50 is mounted on the top plate 11 of the body 10. The control device 50 is electrically connected to the driving module 20 and the detection apparatus 40. The control device 50 mainly comprises a central processor circuit, a memory circuit and other circuits. The memory circuit stores therein a travelling program for defining routes for travelling.

When the robot need to collect table tennis balls on the ground, the robot located at a start position begins to work by turning power suppliers on. The motors 21 of the driving module 20 drive the driving wheels 23 to rotate. Referring to FIGS. 3 to 6, when the robot travels, the driven wheels 25 are driven to revolve by a frictional force of the ground acting the driven wheels 25. The revolving driven wheels 25 drive the ratchets 61 to rotate along a clockwise direction (seen in FIG. 3), and the ratchets 61 drive the driven gears 63 to rotate along a clockwise direction via the intermediate gears 62. The driven gears 63 drive the blades 32 of the rotor means 30 to rotate. The table tennis balls will be picked up by the rotating blades 32 of the rotor means 30 and pushed into the box of the body 10 along a top surface of the guiding member 15. Accordingly, when the robot runs in a travelling route on the ground, at the same time the robot collects the table tennis balls on the ground. The robot turns left or right when it detects an object in front of it. Furthermore, by the nature of the ratchet 61 of each gear set 60, only the rotation of the ratchet 61 can drive the intermediate gear 62 and the driven gear 63 to rotate but not vice versa; thus, a turning of the robot can be achieved by controlling the driving wheels 23 to have different rotating speeds. Finally, after the robot has collected all table tennis balls on the ground, it is programmed to return to the start position.

Alternatively, in another embodiment, the detection apparatus 40 can be omitted. The memory circuit stores therein a travelling program defining a predetermined travelling route inputted according to the arrangement of objects on the ground. The predetermined travelling route should enable the robot to avoid colliding with the objects.

Because the robot automatically travels and picks up the table tennis balls via the control device 50 controlling the driving module 20 and the rotor means 30 to rotate, the table tennis balls are collected into the box of the body 10 and taken out when the robot stops. The robot collects the table tennis balls instead of manual labor; thus the operation of the collection of the table tennis balls has a relatively high efficiency.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A robot for collecting table tennis balls on ground comprising:

a body for receiving the collected table tennis balls therein;

a rotor means rotatably mounted at a front of the body for picking up the table tennis balls into the body;

a driving module mounted on the body, the driving module driving the body to travel on the ground and simultaneously driving the rotor means to rotate; and a control device controlling the driving module to drive the body to travel on the ground.

2. The robot as described in claim 1, wherein the driving module comprises two motors mounted on two lateral and rear portions of the body, two driving wheels connecting with the motors respectively, and two driven wheels mounted on the two lateral and front portions of the body.

3. The robot as described in claim 2, further comprising two gear sets, the driven wheels driving the rotor means to rotate via the gear sets.

4. The robot as described in claim 3, wherein each of the gears set comprises a ratchet mounted on the driven wheel, a driven gear mounted on the rotor means, and an intermediate gear engaging with the ratchet and the driven gear.

5. The robot as described in claim 4, wherein the rotor means comprises two brackets mounted on the front of the body, the intermediate gears pivotally mounted on the brackets.

6. The robot as described in claim 5, wherein the rotor means comprises a shaft having two ends engaged in the brackets and three blades extending radially from an outside surface of the shaft.

7. The robot as described in claim 6, wherein the rotor has a lip extending frontward and downwardly from the body, the blades of the rotor means cooperating with the lip to pick up the table tennis balls.

8. The robot as described in claim 1, wherein the body comprises a bottom plate and three baffle walls extending from the bottom plate, and the bottom plate and the baffle walls form a box for receiving therein the collected table tennis balls.

9. The robot as described in claim 1, further comprising a detection apparatus mounted on the body for avoiding a collision of the robot with an object on the ground.

10. The robot as described in claim 1, further comprising a power supply mounted on the body for supplying electrical current to the driving module and the control device.

11. A robot for collecting table tennis balls on ground comprising:

a body for storing the table tennis balls;

a rotor means rotatably mounted at front of the body, the rotor means comprising a shaft rotatably mounted in respect to the body and three blades extending radially from an outside surface of the shaft, the blades being adapted for picking up the table tennis balls and pushing the table tennis balls into the body;

a driving module driving the body to travel and driving the rotor means to rotate; and a control device controlling the driving module to drive the body to travel on the ground.

12. The robot as described in claim 11, further comprising a gear set, the driving module driving the rotor means to rotate via the gear set.

13. The robot as described in claim 12, wherein the gear set comprises a ratchet mounted on a driven wheel of the driving module, a driven gear fixedly mounted on the shaft of the rotor means, and an intermediate gear engaging with the ratchet and the driven gear.

14. The robot as described in claim 11, further comprises a guiding member having a mounting portion mounted on the body and an arc-shaped lip extending frontward and downwardly from the mounting portion, the blades of the rotor means cooperating with the lip to pick up the table tennis balls.

* * * * *